US008547077B1

(12) United States Patent
Chang

(10) Patent No.: US 8,547,077 B1
(45) Date of Patent: Oct. 1, 2013

(54) VOLTAGE REGULATOR WITH ADAPTIVE MILLER COMPENSATION

(75) Inventor: Jung-Fu Chang, Hsinchu (TW)

(73) Assignee: Skymedi Corporation, Hsinchu (TW)

( * ) Notice: Subject to any disclaimer, the term of this patent is extended or adjusted under 35 U.S.C. 154(b) by 77 days.

(21) Appl. No.: 13/423,064

(22) Filed: Mar. 16, 2012

(51) Int. Cl.
*G05F 1/565* (2006.01)

(52) U.S. Cl.
USPC ..... 323/275

(58) Field of Classification Search
USPC ..... 323/273, 274, 275, 279, 280, 315
See application file for complete search history.

(56) References Cited

U.S. PATENT DOCUMENTS

| | | | | |
|---|---|---|---|---|
| 6,856,124 | B2 * | 2/2005 | Dearn et al. | 323/280 |
| 6,946,821 | B2 * | 9/2005 | Hamon et al. | 323/273 |
| 8,169,203 | B1 * | 5/2012 | Vemula | 323/273 |
| 2010/0066320 | A1 | 3/2010 | Dasgupta et al. | |
| 2011/0018510 | A1 | 1/2011 | Gao et al. | |
| 2011/0267017 | A1 * | 11/2011 | Zhang et al. | 323/280 |
| 2012/0262135 | A1 * | 10/2012 | Childs | 323/269 |
| 2012/0299564 | A1 * | 11/2012 | Howes et al. | 323/281 |

* cited by examiner

*Primary Examiner* — Gary L Laxton
(74) *Attorney, Agent, or Firm* — Stout, Uxa, Buyan & Mullins, LLP

(57) ABSTRACT

A voltage regulator with adaptive Miller compensation includes a first amplifier and a second amplifier. An adaptive compensation circuit includes serially connected compensation capacitor and a compensation transistor coupled to the second amplifier. A bias circuit generates a proper bias control voltage to dynamically control the adaptive compensation circuit in a manner that the adaptive compensation transistor operates in a deep triode region with weakly-inverted channel or strongly-inverted channel. An output circuit generates an output voltage according to which the feedback voltage is generated. The resistance of the compensation transistor varies according to a load of the voltage regulator under control of the bias control voltage. The bias circuit generates a mirror current that copies at least a portion of a current flowing in the output circuit, and the bias control voltage is then generated according to the mirror current.

11 Claims, 4 Drawing Sheets

VOLTAGE REGULATOR WITH ADAPTIVE MILLER COMPENSATION

BACKGROUND OF THE INVENTION

1. Field of the Invention

The present invention generally relates to a voltage regulator, and more particularly to a voltage regulator with adaptive Miller compensation.

2. Description of Related Art

A voltage regulator is an electrical circuit used to automatically maintain a constant voltage level, and finds widespread applications in a variety of electronic devices and systems. In order to adapt the voltage regulator to either a heavy load or a light load, a conventional voltage regulator is typically compensated by a compensation circuit, for example, made of a resistor and a capacitor.

A closed-loop phase margin of the voltage regulator, however, cannot be dynamically adjusted by the compensation circuit made of the resistor with a constant resistance and the capacitor with a constant capacitance. Transient voltage ripple therefore occurs in the output of the voltage regulator whenever being adapted to a light load.

A need has thus arisen to propose a novel voltage regulator with compensation dynamically adaptable to either the light load or the heavy load.

SUMMARY OF THE INVENTION

In view of the foregoing, it is an object of the embodiment of the present invention to provide a voltage regulator with adaptive Miller compensation such that the voltage regulator may have a sufficient phase margin (e.g., 45° or above) in either a light load or a heavy load, thereby substantially lowering voltage ripple effect.

According to one embodiment, a voltage regulator with adaptive Miller compensation includes a first amplifier, a second amplifier, an adaptive compensation circuit, a bias circuit and an output circuit. The first amplifier is coupled to receive a reference voltage and a feedback voltage. The second amplifier is coupled to receive an output of the first amplifier. The adaptive compensation circuit has two ends that are coupled to an input node and an output node of the second amplifier respectively, and the adaptive compensation circuit includes a compensation capacitor and a compensation transistor that are serially connected. The bias circuit is configured to generate a proper bias control voltage to dynamically control the adaptive compensation circuit in a manner that the adaptive compensation transistor operates in a deep triode region with weakly-inverted channel or strongly-inverted channel. The output circuit is coupled to receive the output of the second amplifier, the output circuit being configured to generate an output voltage of the voltage regulator according to which the feedback voltage is generated. The resistance of the compensation transistor varies according to a load of the voltage regulator under control of the bias control voltage. The bias circuit generates a mirror current that copies at least a portion of a current flowing in the output circuit, and the bias control voltage is then generated according to the mirror current.

DETAILED DESCRIPTION OF THE INVENTION

Figure 1:
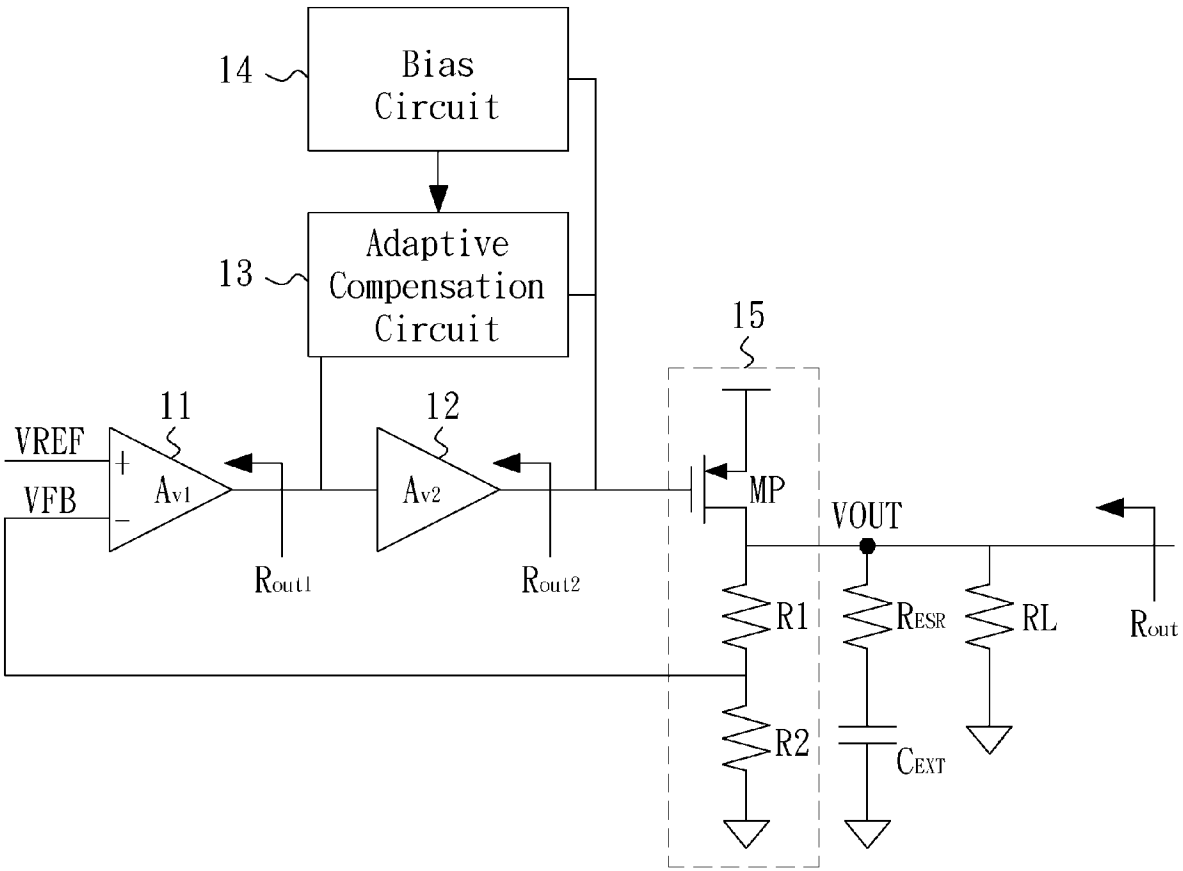
FIG. 1 shows a block diagram illustrating a voltage regulator with adaptive Miller compensation according to one embodiment of the present invention.

FIG. 1 shows a block diagram illustrating a voltage regulator with adaptive Miller compensation according to one embodiment of the present invention. In the embodiment, the voltage regulator includes a first amplifier 11, a second amplifier 12, an adaptive compensation circuit 13, a bias circuit 14 and an output circuit 15.

Specifically speaking, the first (stage) amplifier 11, preferably a differential amplifier or a folded-cascode amplifier with a non-inverting input node and an inverting input node, is coupled to receive a reference voltage VREF, for example, at the non-inverting input node and a feedback voltage VFB (provided from the output circuit 15), for example, at the inverting input node. The DC (direct-current) gain $A_{v1}$ of the first amplifier 11 may be generally expressed as $A_{v1}=gm_1R_{out1}$, where $gm_1$ is a first (stage) transductance, and $R_{out1}$ is a first (stage) output impedance looking into an output node of the first amplifier 11.

The second amplifier 12, e.g., a common source amplifier, is coupled to receive an output of the first amplifier 11. The DC gain $A_{v2}$ of the second amplifier 12 may be generally expressed as $A_{v2}=gm_2R_{out2}$, where $gm_2$ is a second (stage) transductance, and $R_{out2}$ is a second (stage) output impedance looking into an output node of the second amplifier 12.

The adaptive compensation circuit 13 has two ends that are coupled to an input node and an output node of the second amplifier 12, respectively. The bias circuit 14 provides a proper bias control voltage to dynamically control the adaptive compensation circuit 13.

The output circuit 15 is coupled to receive an output of the second amplifier 12, and generates an output voltage VOUT of the voltage regulator. The DC gain $A_{v3}$ of the output circuit 15 may be generally expressed as $A_{v3}=gm_pR_{out}$, where $gm_p$ is a third (stage) transductance, and $R_{out}$ is a third (stage) output impedance looking into an output node of the output circuit 15.

Figure 2:
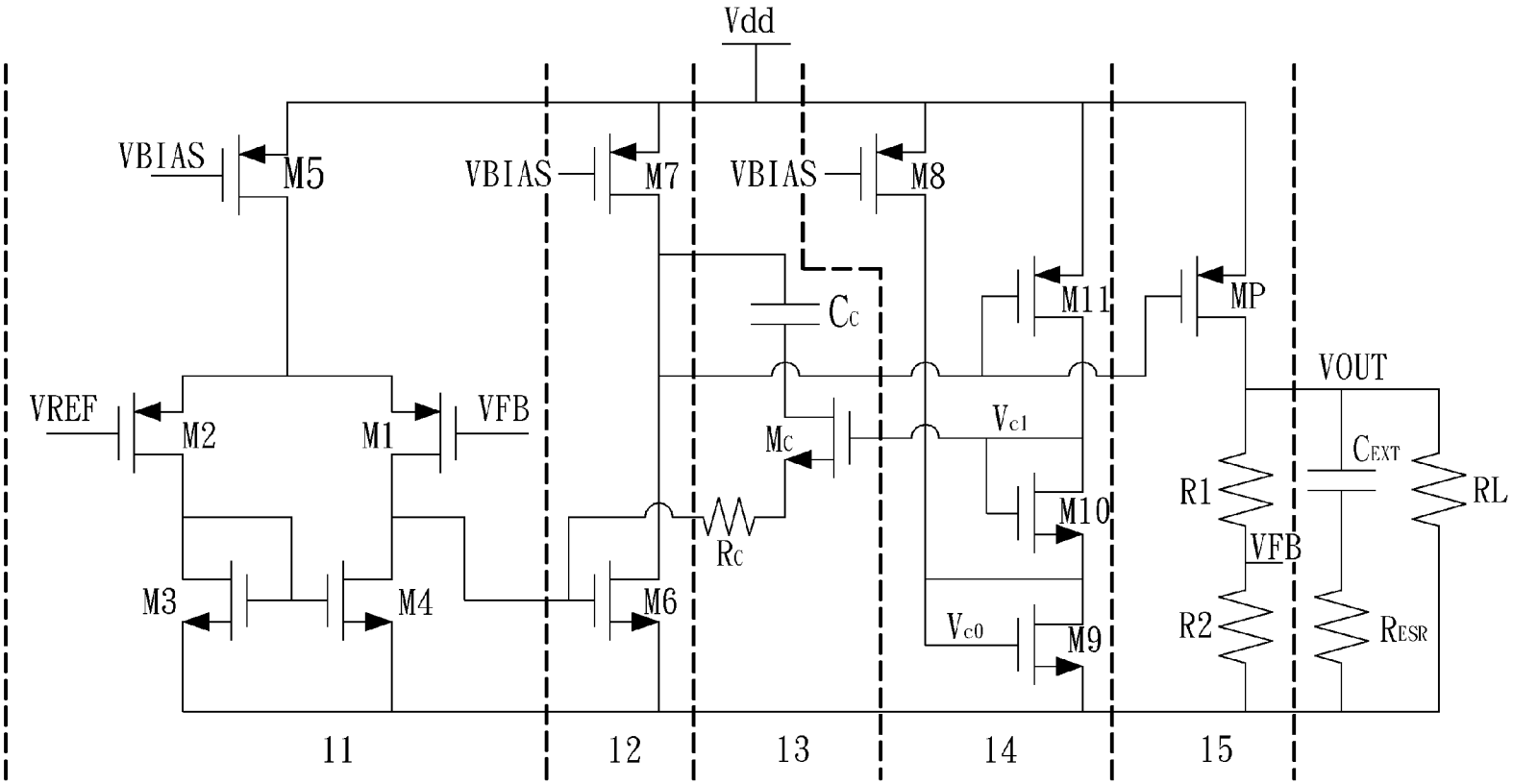
FIG. 2 shows detailed circuitry of an exemplary voltage regulator of FIG. 1.

FIG. 2 shows detailed circuitry of an exemplary voltage regulator of FIG. 1. In the exemplary embodiment, the first amplifier 11 includes a differential amplifier made of p-type metal-oxide-semiconductor (PMOS) transistors M1, M2, M5 and n-type metal-oxide-semiconductor (NMOS) transistors M3, M4. The transistors M1-M5 are electrically coupled between a first power supply (e.g., Vdd) and a second power supply (e.g., ground). The non-inverting input node (i.e., a gate of the PMOS transistor M2) is coupled to receive the reference voltage VREF, and the inverting input node (i.e., a gate of the PMOS transistor M1) is coupled to receive the feedback voltage VFB (provided from the output circuit 15). The output node (i.e., an interconnect node between the NMOS transistor M4 and the PMOS transistor M1) of the first amplifier 11 provides an output that is fed to the second amplifier 12.

The second amplifier 12 of the exemplary embodiment includes a common source amplifier made of a PMOS transistor M7 and a NMOS transistor M6, which are serially connected, and are electrically coupled between the first power supply (e.g., Vdd) and the second power supply (e.g., ground). The input node (i.e., a gate of the NMOS transistor M6) is coupled to receive the output of the first amplifier 11, and the output node (i.e., an interconnect node between the PMOS transistor M7 and the NMOS transistor M6) provides an output that is fed to the output circuit 15.

In the exemplary embodiment, the adaptive compensation circuit 13 includes at least a compensation capacitor Cc, a compensation resistor $R_c$, and a variable resistor that is implemented by a (NMOS) compensation transistor Mc, which are serially connected between the input node and the output node of the second amplifier 12. Particularly, in the exemplary embodiment, the serially connected compensation capacitor $C_c$, the compensation resistor $R_c$ and the compensation transistor Mc are directly connected between the input node and the output node of the second amplifier 12. The resistance $R_z$ of the compensation transistor (or variable resistor) Mc varies according to the load RL. Specifically, a gate of the compensation transistor Mc is controlled by the bias control voltage Vc1 outputted from the bias circuit 14.

The bias circuit 14 of the exemplary embodiment includes a mirror (PMOS) transistor M11 and diode-connected NMOS transistors M9, M10. That is, a gate and a drain of the NMOS transistor M9 are connected together, a gate and a drain of the NMOS transistor M10 are connected together, and the drain of M9 is connected with a source of M10. The mirror transistor M11 and the diode-connected transistors M9, M10 are serially connected between the first power supply (e.g., Vdd) and the second power supply (e.g., ground). An interconnect node between the mirror transistor M11 and the diode-connected transistors M9, M10 provides the bias control voltage to (the gate of the compensation transistor Mc of) the adaptive compensation circuit 13.

Specifically, the mirror transistor M11 mirrors (or copies) at least a portion of a current flowing in a power (PMOS) transistor MP of the output circuit 15. In other words, the mirror transistor M11 and the power transistor MP together form a current mirror. For example, the mirror transistor M11 generates a mirror current having a value of 1/K times the current flowing in the power transistor MP, if size ratio of M11 and MP is M11:MP=1:K (K>1).

In addition to the power transistor MP, the output circuit 15 also includes a voltage divider made of serially connected resistors R1 and R2. The power transistor MP and the voltage divider (R1/R2) are serially connected between the first power supply (e.g., Vdd) and the second power supply (e.g., ground). The voltage divider provides a divided voltage (i.e., the feedback voltage) VFB that is fed back to the first amplifier 11.

When the load RL becomes heavy (i.e., smaller-value resistance RL), the mirror current increases, and the bias control voltage Vc1 accordingly increases and becomes $Vc1=V_{GS9}+V_{GS10}=(V_{OV9}+V_{TH9})+(V_{OV10}+V_{TH10})$, where $V_{GS9}$, $V_{OV9}$ and $V_{TH9}$ represent a gate-to-source voltage, an overdrive voltage and a threshold voltage, respectively, of the transistor M9; and $V_{GS10}$, $V_{OV10}$ and $V_{TH10}$ represent a gate-to-source voltage, an overdrive voltage and a threshold voltage, respectively, of the transistor M10. As $V_{OV10}$ has a value greater than zero, the compensation transistor Mc thus operates in a deep triode region with strongly-inverted channel. In the specification, the deep triode region with strongly-inverted channel means that the compensation transistor Mc satisfies the following condition: $V_{OV,MC}=V_{GS,MC}-V_{TH,MC}>0$, $V_{DS,MC}\approx 0$). As a result, the resistance $R_z$ of the compensation transistor Mc decreases, and the frequency of the zero increases. The frequency of the zero is z2 of the following transfer function (neglecting pole and zero at high frequency):

$$H(s)=\frac{A_0(1+s/z1)(1+s/z2)}{(1+s/p1)(1+s/p2)}$$

where an open-loop DC gain $A_o=gm_1R_{out1}gm_2R_{out2}gm_pR_{out}$, and an output pole $p1=1/R_{out}C_{ext}$, a first (stage) output pole $p2\approx 1/R_{out1}gm_2R_{out2}C_e$, an output zero $z1=1/R_{ESR}C_{ext}$ ($R_{ESR}$ is a resistance serially connected with $C_{ext}$), and the zero z2 varies according to the load $z2\approx 1/(R_z+R_c)C_c$ (provided that $R_z+R_c>>1/gm_2$).

When the load RL becomes light (i.e., larger-value resistance RL), the mirror current decreases, and the bias control voltage Vc1 accordingly decreases. As a result, the resistance $R_z$ of the compensation transistor Mc increases, and the frequency of the zero decreases. In order to prevent over-compensation due to excessively small Vc1 and thus excessively large resistance $R_z$, a bias sub-circuit (e.g., made of a PMOS transistor M8) that is independent of the load RL is utilized in the exemplary embodiment to provide an internal bias voltage Vc0 for (the transistor M9 of) the diode-connected transistors M9, M10. Specifically, a gate of the transistor M8 is fixed biased, and a drain of the transistor M8 is electrically connected to a gate of the transistor M9. In a zero load, the internal bias voltage $Vc0=V_{GS9}=(V_{OV9}+V_{TH9})\approx V_{O1}$, where $V_{O1}$ is the output of the first amplifier 11, and the overdrive voltage $V_{OV9}$ (of the transistor M9)$=V_{GS9}-V_{TH9}$. The bias control voltage Vc1 thus becomes $Vc1=V_{GS9}+V_{GS10}=(V_{OV9}+V_{TH9})+(V_{OV10}+V_{TH10})$, where $V_{OV10}$ has a value less than zero, the compensation transistor Mc thus operates in a deep triode region with weakly-inverted channel. In the specification, the deep triode region with weakly-inverted channel means that the compensation transistor Mc satisfies the following condition: $V_{OV,MC}=V_{GS,MC}-V_{TH,MC}<0$, $V_{DS,MC}\approx 0$). It is noted that in either the light load or the heavy load, no current (or a neglectfully small current) flows in the compensation transistor Mc, and therefore the input node (i.e., the gate of transistor M6) of the second amplifier 12 maintains at a constant voltage level.

Figure 3:
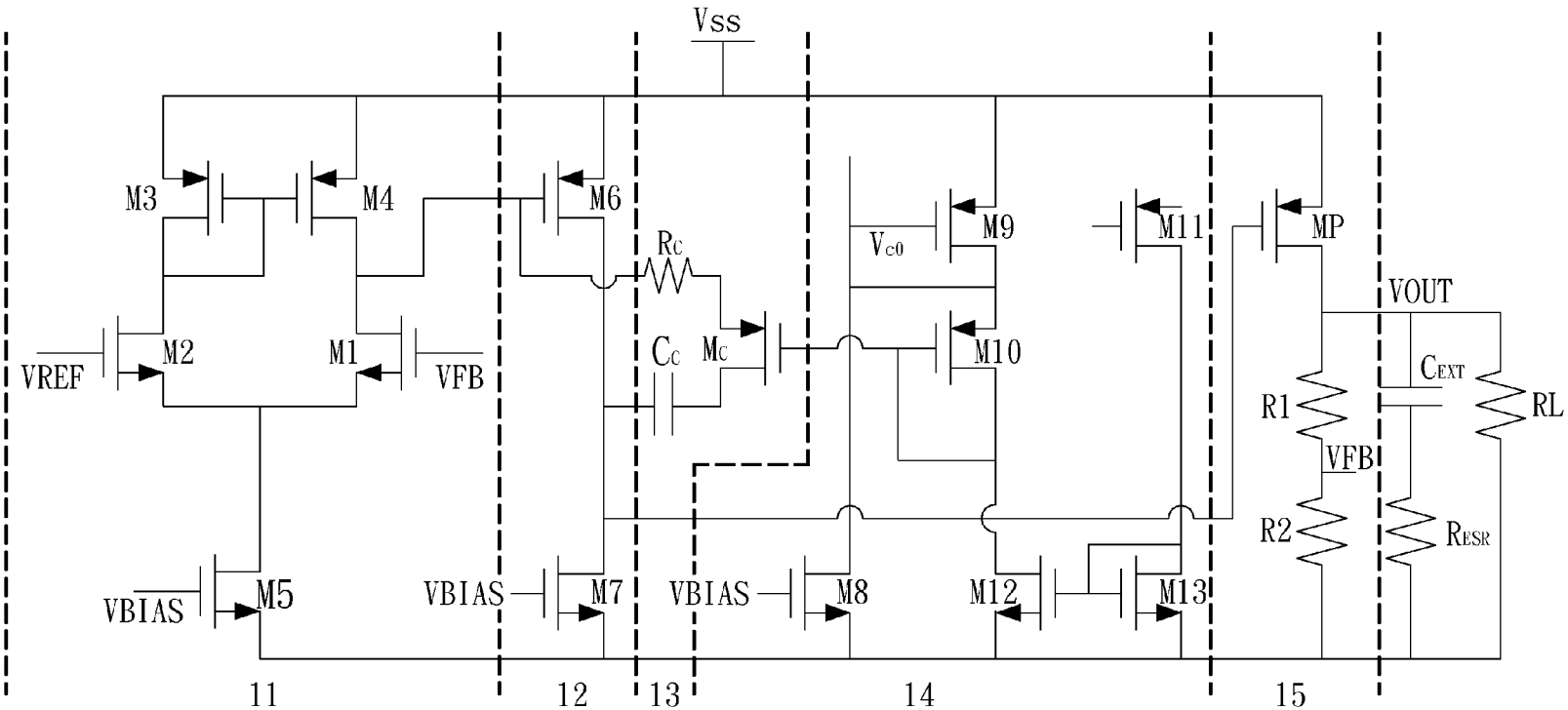
FIG. 3 shows detailed circuitry of another exemplary voltage regulator of FIG. 1.

FIG. 3 shows detailed circuitry of another exemplary voltage regulator of FIG. 1. The circuitry configuration of FIG. 3 is similar to that of FIG. 2 with minor modification, with the exception that PMOS transistors are replaced with NMOS transistors, and vice versa. In the embodiment, the mirror transistor M12 generates the mirror current according to a current flowing in transistors M11 and M13. In other words, the mirror transistor M12 in the embodiment indirectly copies the current flowing in the power transistor MP. The first power supply, in the embodiment, is the ground, and the second power supply is Vss.

Figure 4:
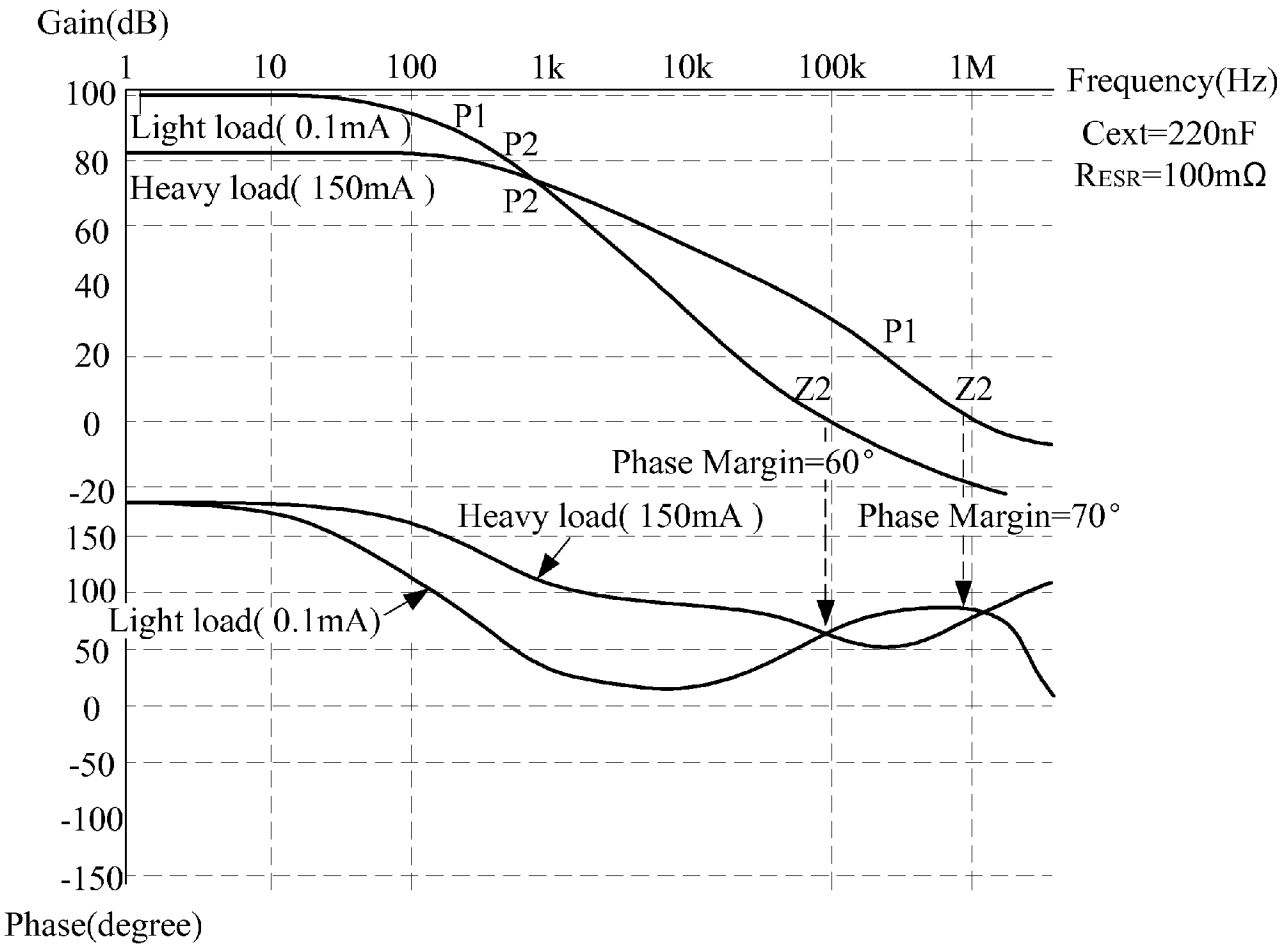
FIG. 4 shows exemplary frequency responses of the voltage regulator in FIG. 2 or FIG. 3.

FIG. 4 shows exemplary frequency responses of the voltage regulator in FIG. 2 or FIG. 3. When the load RL is light, the pole p1 becomes the dominant pole and the pole p2 is a second pole. The bias control voltage Vc1 decreases such that the compensation transistor Mc operates in a deep triode region with weakly-inverted channel, and the resistance $R_z$ of the compensation transistor Mc substantially increases, for example, to 1 mega ohm (Ω) or above. The zero z2 shifts toward the pole p2, and a sufficient phase margin may thus be obtained. When the load RL is heavy, the third (stage) output impedance $R_{out}$ decreases and the bias control voltage Vc1 increases such that the compensation transistor Mc operates in a deep triode region with strongly-inverted channel, and the resistance $R_z$ of the compensation transistor Mc substantially decreases, for example, to tens of kilo ohm (Ω)) or below. The pole p1 and the zero z2 both shift toward higher frequency, and the pole p2 becomes the dominant pole and the pole p1 is a second pole. In either the light load or the heavy load, z2 should be more closed to unit-gain frequency than p1 and p2, such that a sufficient phase margin may thus be obtained. According to the responses shown in FIG. 4, the phase margin is 60° in the light load, and is 70° in the heavy load, both of which are satisfactorily greater than 45°.

Although specific embodiments have been illustrated and described, it will be appreciated by those skilled in the art that various modifications may be made without departing from the scope of the present invention, which is intended to be limited solely by the appended claims.

What is claimed is:

1. A voltage regulator with adaptive Miller compensation, comprising;

a first amplifier coupled to receive a reference voltage and a feedback voltage;

a second amplifier coupled to receive an output of the first amplifier;

an adaptive compensation circuit with two ends that are coupled to an input node and an output node of the second amplifier respectively, the adaptive compensation circuit comprising a compensation capacitor and a compensation transistor that are serially connected;

a bias circuit configured to generate a proper bias control voltage to dynamically control the adaptive compensation circuit in a manner that the adaptive compensation transistor operates in a deep triode region with weakly-inverted channel or strongly-inverted channel; and an output circuit coupled to receive the output of the second amplifier, the output circuit being configured to generate an output voltage of the voltage regulator according to which the feedback voltage is generated;

wherein a resistance of the compensation transistor varies according to a load of the voltage regulator under control of the bias control voltage; and wherein the bias circuit generates a mirror current that copies at least a portion of a current flowing in the output circuit, and the bias control voltage is then generated according to the mirror current.

2. The voltage regulator of claim 1, wherein the first amplifier comprises a differential amplifier or a folded-cascode amplifier with a non-inverting input node and an inverting input node coupled to the reference voltage and the feedback voltage respectively.

3. The voltage regulator of claim 1, wherein the second amplifier comprises a common source amplifier.

4. The voltage regulator of claim 3, wherein the second amplifier comprises a p-type metal-oxide-semiconductor (PMOS) transistor and an n-type metal-oxide-semiconductor (NMOS) transistor that are serially connected by electrically connecting a drain of the PMOS transistor with a drain of the NMOS transistor, wherein a gate of the PMOS transistor or the NMOS transistor is configured as the input node of the second amplifier, and an interconnect node of the PMOS transistor and the NMOS transistor is configured as the output node of the second amplifier.

5. The voltage regulator of claim 1, wherein the adaptive compensation circuit further comprises a compensation resistor serially connected with the compensation capacitor and the compensation transistor.

6. The voltage regulator of claim 1, wherein the compensation transistor comprises a metal-oxide-semiconductor (MOS) transistor with a gate coupled to receive the bias control voltage.

7. The voltage regulator of claim 1, wherein the bias circuit comprises:

a mirror transistor configured to generate the mirror current; and at least one diode-connected transistor serially connected with the mirror transistor;

wherein an interconnect node between the mirror transistor and the at least one diode-connected transistor provides the bias control voltage.

8. The voltage regulator of claim 7, wherein the output circuit comprises:

a voltage divider configured to generate the feedback voltage; and a power transistor serially connected with the voltage divider, wherein a current flowing in the power transistor varies according to the load, and at least a portion of the current flowing in the power transistor is copied in the mirror transistor of the bias circuit.

9. The voltage regulator of claim 7, wherein the bias control voltage increases when the load increases, and an overdrive voltage of the diode-connected transistor is greater than zero, such that the compensation transistor operates in the deep triode region with strongly-inverted channel; and the bias control voltage decreases when the load decreases, and the overdrive voltage of the diode-connected transistor is less than zero, such that the compensation transistor operates in the deep triode region with weakly-inverted channel.

10. The voltage regulator of claim 9, wherein the bias circuit further comprises a bias sub-circuit that is independent of the load for providing an internal bias voltage to one of the at least one diode-connected transistor, such that the compensation transistor operates in the deep triode region with weakly-inverted channel in the zero load.

11. The voltage regulator of claim 10, wherein the bias sub-circuit comprises a MOS transistor with a gate fixedly biased, and a drain electrically connected to a gate of one of the at least one diode-connected transistor.

* * * * *